United States Patent [19]

Johns

[11] 4,405,165

[45] Sep. 20, 1983

[54] TEMPORARY DOOR LOCKING DEVICE

[76] Inventor: Blair E. Johns, 1002 N. 91st Ave., Tolleson, Ariz. 85353

[21] Appl. No.: 246,241

[22] Filed: Mar. 23, 1981

[51] Int. Cl.[3] ..... E05C 19/18

[52] U.S. Cl. ..... 292/258

[58] Field of Search ..... 292/258, 288, 292, 295

[56] References Cited

U.S. PATENT DOCUMENTS

| | | | |
|---|---|---|---|
| 633,078 | 9/1899 | Crane et al. | 292/292 |
| 2,226,640 | 12/1940 | Smythe | 292/295 |
| 2,665,935 | 1/1954 | Patterson | 292/292 |
| 3,181,319 | 5/1965 | Hudon | 292/292 X |
| 3,834,746 | 9/1974 | Hinden | 292/295 X |
| 4,326,394 | 4/1982 | Stein | 292/292 X |

*Primary Examiner*—Richard E. Moore

*Attorney, Agent, or Firm*—Herbert E. Haynes, Jr.

[57] ABSTRACT

A device for demountable temporary locking of a door is configured for use in locking inwardly and outwardly opening doors from either or both the inside and the outside. The device includes a door engaging member having a collar plate removably mounted thereon for lockably mounting the door engaging member on the door, and having a slidably movable door jamb engaging member which is lockable in its door jamb engaging position.

16 Claims, 3 Drawing Figures

TEMPORARY DOOR LOCKING DEVICE

BACKGROUND OF THE INVENTION

1. Field of the Invention

This invention relates to door locks and more particularly to a demountable temporary door locking device for use when a door lacks or has an inoperative permanent self contained lock.

2. Description of the Prior Art

Many situations arise in which a temporary and demountable door locking device is desirable and in some instances, a necessity. Some examples of such situations are; for use by travelers wanting security in addition to the usual permanent door locks provided such as in hotels, motels, and the like; for use by landlords in locking out tenants that are delinquent in their rent payments; for use during periods when now locks, or rekeying work is pending; and for use when a lock or door is damaged as a result of vandalism or burglary.

However, the most pressing need for this type of a device is in the construction arts for use between the times when it becomes possible and desirable to prevent unauthorized access to a structure and when the permanent door locks are installed, which is usually at or near completion of the construction job. The need for temporary and demountable locking devices is necessary in this phase of building construction due to the high incidence of distructive vandalism, theft of construction materials, fixtures and the like, and to prevent youngsters from playing in areas which are naturally attractive to them and where they are particularly susceptable to injury.

It is a common practice to bar the doors at construction sites by using a long carriage bolt which passes through two 2×4 studs mounted in transverse engagement with the opposite sides of the door jamb and passes through the door knob hole formed in most doors at the time of manufacture. When this technique is employed, the nut used on the carriage bolt must be located on the inside of the building and the person installing this type of door barring device must leave some means open for him to leave the structure. Therefore, the use of this door securing technique is limited in that it cannot be used at all in the absence of door knob holes, and can be used in all but one door when such holes are formed in the doors.

Other techniques sometimes used are to nail the door itself shut, or to nail a piece of wood to the door jamb at a place where it prevents hinged movement of the door. In addition to marring or damaging the door or its jamb which is the obvious disadvantage of these techniques, the security provided is less than satisfactory in that any force which exceeds what may be referred to as a normal push, will in many instances force the door open.

U.S. Pat. No. 2,845,295, suggests the use of a door securing device which includes a pair of plates, one of which is screwed to the door jamb with the other aligningly screwed to the free edge of the door. When the door is closed, these plates extend from the crack between the door and its jamb and a padlock is passed through aligned apertures formed in the plates. This device cannot be reasonably classified as a temporary demountable door locking device due to the screws which are required to attach the plates both to the door and to the jamb. Further, this device is suitable for use in interior locking of inwardly swinging doors or alternately for use in exterior locking of outwardly swinging doors, not both, and cannot be used at all for exterior locking of inwardly swinging doors.

U.S. Pat. No. 3,181,319, suggests the use of a temporary and demountable door locking device which includes an elongated metal strap which is bent into a C-shaped configuration on one end thereof and is provided with apertures on its other end. Thumb screws are mounted on the C-shaped end of the metal strap and are used to clampingly secure the strap to the projecting stop shoulder of the door jamb in a manner so that its apertured other end extends through the crack between the door and its jamb, with its apertures exposed for receiving a suitable padlock. When mounted in this fashion, the device may be used to prevent unauthorized access into a building by application of a padlock to the metal strap at the exterior of an outwardly swinging door. But, it cannot be used for exterior padlocking of an inwardly swinging door. Although this same locking structure is disclosed in this patent as being clampingly secured to the edge of the door for use in situations which require exterior locking of an inwardly swinging door, such use cannot be implemented in that clamping attachment of the metal strap to the edge of the door must be accomplished with the door open and when accomplished, the apertured other end of the metal strap interferingly engages the door jamb when attempts are made to swing the door shut. Thus, the use of this particular type of prior art door securing device is limited for use only in situation which require exterior padlocking of outwardly swinging doors.

Therefore, a need exists for a new and useful temporary demountable door locking device which overcomes some of the problems and shortcomings of the prior art door barring techniques and locking devices.

SUMMARY OF THE INVENTION

In accordance with the present invention, a new and improved temporary demountable door lock device is disclosed as including a door engaging member with a door jamb engaging member slidably carried thereon. These door and door jamb engaging members are especially configured and interact with each other to allow padlocking from either or both sides of inwardly and outwardly opening doors and can be used on all door/-door jamb configurations known to me.

The door engaging member is in the form of an L-shaped metal strap having an elongated portion with a tongue extending at a right angle from one end thereof. The elongated portion is for placement in contiguous engagement with one of the planar surfaces of the door in a manner which locates the tongue so that it is transverse with respect to the free edge of the door and extends beyond the opposite planar surface of the door. Such positioning of the door engaging member will result in the tongue protruding from the crack between the door and the door jamb when the door is in the closed position. The extending end of the tongue has an aperture formed therethrough and a collar plate is provided for sliding onto the tongue so that the apertures formed in the collar plate will align with the aperture of the tongue for receiving a padlock or other securing device. The collar plate is configured to overlay at least the door to prevent opening of the door. The elongated portion of the door engaging member is provided with a normally extending apertured tab and has channels formed on its longitudinal edges.

The door jamb engaging member includes a flat plate which is slidably movable in the channels provided on the door engaging member so that the door jamb engaging member is movable toward and away from the door jamb. The door jamb engaging member is provided with means for gripping the protruding door stop shoulder of the door jamb and when so positioned, an apertured tab protruding from the plate is in alignment with the tab provided on the door engaging member for receiving a padlock or other means for preventing sliding movement of the door jamb engaging member in a direction away from the door jamb. The means provided on the door jamb engaging member for gripping the door jamb shoulder is adjustable so that it is capable of being grippingly mounted on variously sized protruding door stop shoulders of various door jambs.

Accordingly, it is an object of the present invention to provide a new and improved temporary demountable door locking device.

Another object of the present invention is to provide a new and improved temporary demountable door locking device which may be used on both inwardly and outwardly opening doors.

Another object of the present invention is to provide a new and improved temporary demountable door locking device which is adapted to lockably secure an inwardly opening door from either or both sides thereof.

Another object of the present invention is to provide a new and improved temporary demountable door locking device which is adapted to lockably secure an outwardly opening door from either or both sides thereof.

Another object of the present invention is to provide a new and improved temporary demountable door locking device which is adjustable for use with door jambs having variously sized protruding door stop shoulders.

Another object of the present invention is to provide a new and improved temporary demountable door locking device of the above described character which includes a door engaging member having a door jamb engaging member movably carried thereon for movement toward and away from the door jamb when the door engaging member is in place on the door.

The foregoing and other objects of the present invention as well as the invention itself may be more fully understood from the following description when read in conjunction with the accompanying drawings.

DESCRIPTION OF THE PREFERRED EMBODIMENT

Referring more particularly to the drawings, wherein the temporary demountable door locking device of the present invention is seen to include the components of a door engaging member 10, a collar plate 12 and a door jamb engaging member 14.

Figure 1:
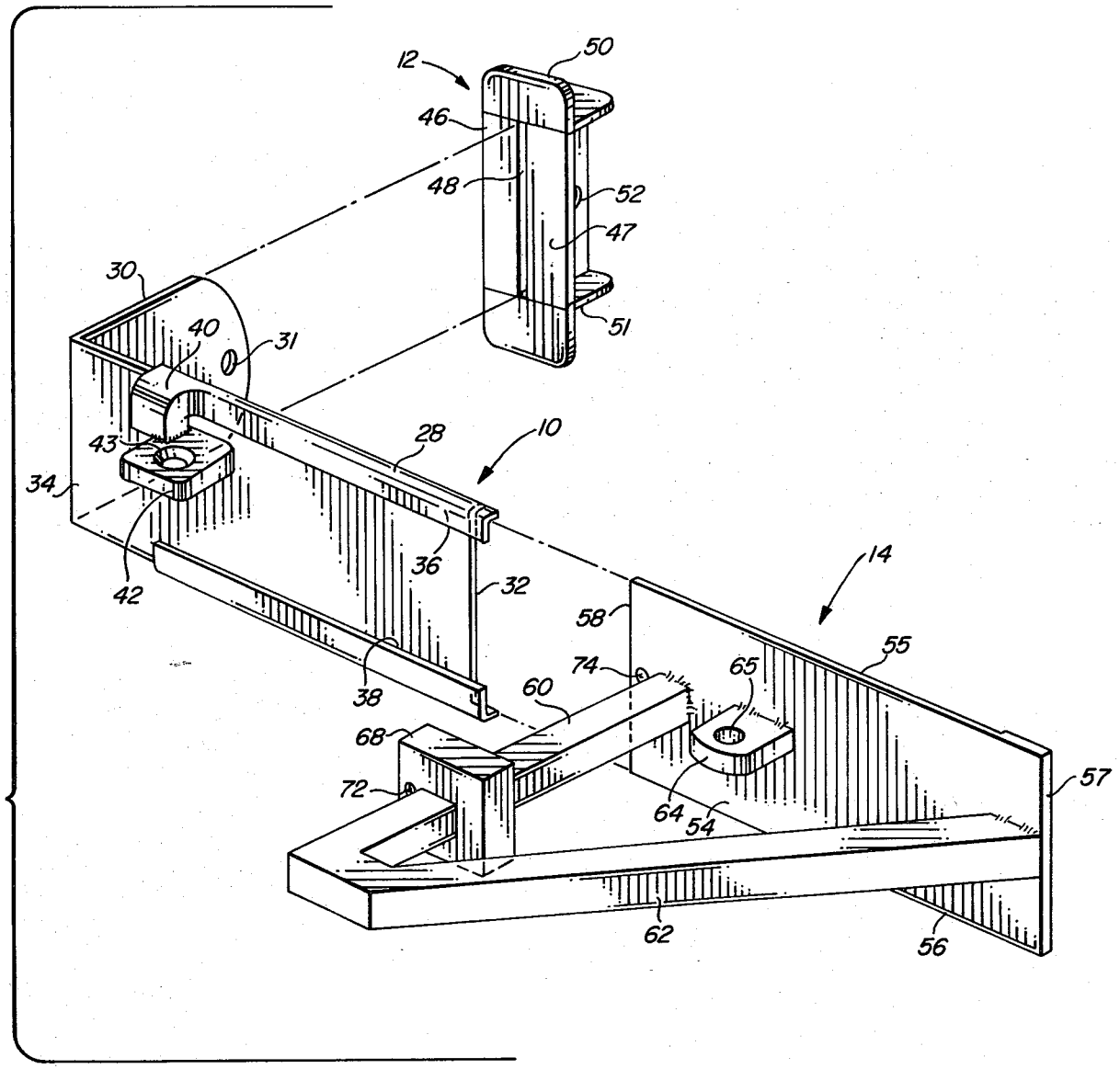
FIG. 1 is an exploded perspective view of the temporary demountable door locking device of the present invention illustrating the various features thereof.
Figure 2:
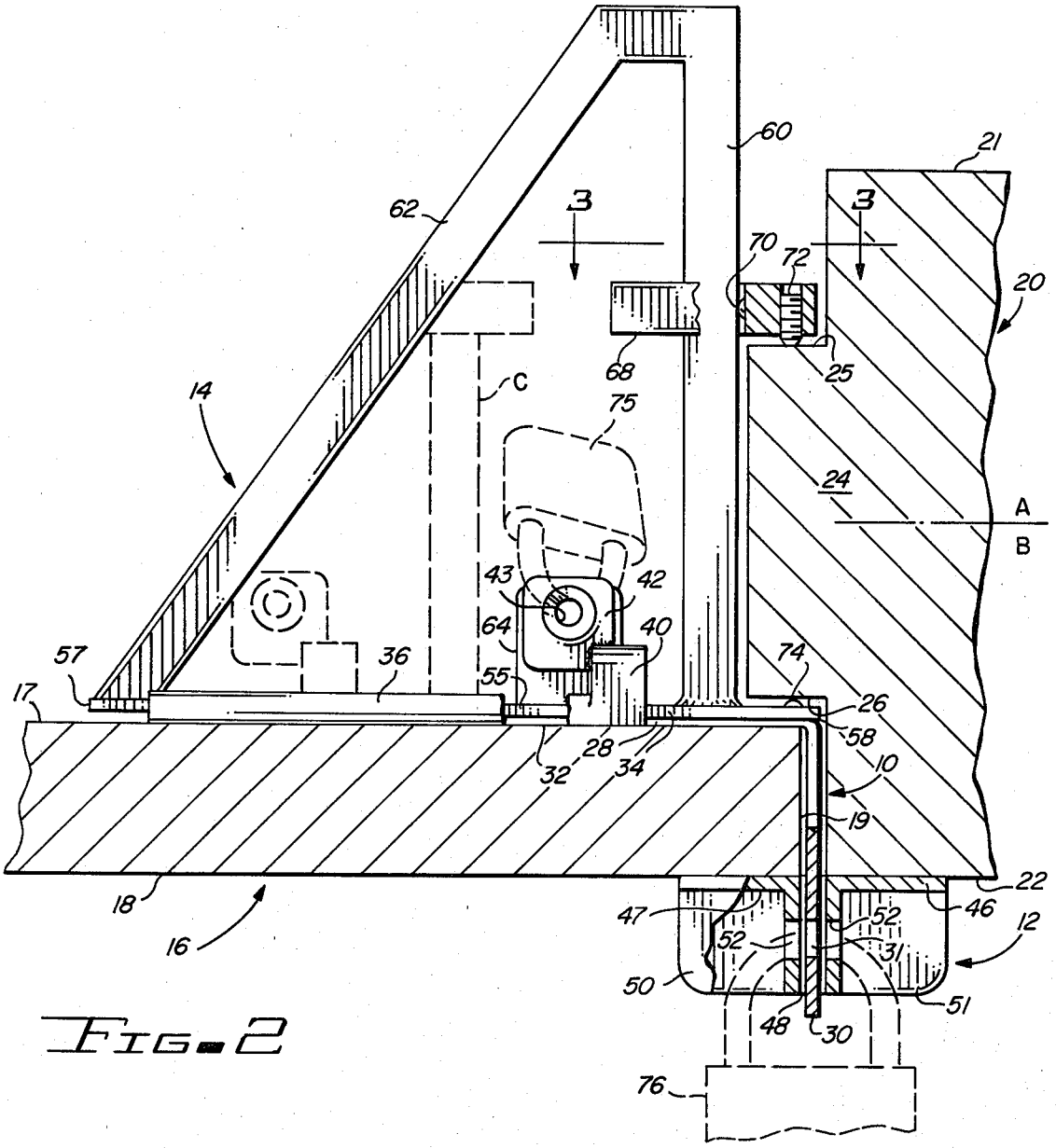
FIG. 2 is a sectional view showing fragmentary portions of a typical door and door jamb structure with the temporary demountable door lock of the present invention mounted thereon.

Before proceeding with the detailed description of the components mentioned above, it will be advantageous to note that the door locking device is for use on all swinging doors such as the typical door/door jamb assembly fragmentarily illustrated in FIG. 2. The door assembly includes a typical door 16 having a first planar surface 17, a second, or opposite, planar surface 18, and a free vertical edge 19 which is referred to as being free in that it is opposite to the edge (not shown) by which the door is hingedly mounted in the usual manner. The door jamb 20 includes the usual opposed side edges 21 and 22 and an inwardly projecting door stop shoulder 24 which itself defines opposed side edges 25 and 26.

The door engaging member 10 of the door locking device of the present invention is formed from a metal strap of suitable thickness which is bent along its length into an L-shaped configuration defining an elongated substantially rectangular portion 28 with a tongue 30 extending at a right angle from one end thereof, with the tongue having an aperture 31 formed therethrough.

The elongated portion 28 of the door engaging member 10 is of substantially rectangular configuration as hereinbefore mentioned, with a first planar surface 32 which faces in the same direction as the tongue 30, and a second, or opposite, planar surface 34. The elongated portion 28 is configured such as by bending of the metal strap to form a channel 36 extending along at least a portion of one of its longitudinal edges with the channel opening onto the planar surface 34. A similar channel 38 is provided so as to extend along at least a portion of the other longitudinal edge of the elongated portion 28, and it too also opens onto the planar surface 34. The channels 36 and 38 cooperatively serve as means for slidably retaining the door jamb engaging member 14 as will hereinafter be described in detail.

An ear 40 is suitably attached, such as by welding, to the bent over portion of metal which defines the channel 36 provided on the elongated portion 28 of the door engaging member 10. The ear 40 extends normally with respect to the planar surface 34 and is bent along its length into a substantially right angle so as to be spaced from the planar surface 34. A tab 42, having an aperture 43 formed therethrough, is affixed to the bent over end of the ear 40 and is disposed so as to be spaced from the planar surface 34 and normal with respect thereto.

The collar plate 12 includes a first pair of juxtaposed right angle members 46 and 47 which face oppositely and are spaced apart to define the opposite sides of an elongated slot 48 which passes through the collar plate 12. A second pair of oppositely facing right angle members 50 and 51 are each fixedly and transversely attached, such as by welding, on different aligned ends of the first pair of angle members 46 and 47 so as to define the ends of the elongated slot 48. The first pair of right angle members 46 and 47 have aligned apertures 52 formed therein which align with the aperture 31 of the tongue 30 when the collar plate 12 is removably mounted on the door engaging member 10 as will hereinafter be described in detail.

The door jamb engaging member 14 includes a flat plate 54 of substantially rectangular configuration having longitudinal side edges 55 and 56 with end edges 57 and 58. The width dimension of the flat plate 54 is such that its longitudinal edges 55 and 56 are slidably receivable in the channels 36 and 38 of the door engaging member 10 for reasons which will become apparent as this description progresses.

A bar 60 is fixedly mounted on the flat plate 54 so as to extend normally therefrom from a location which is adjacent and set back from the end edge 58 of the plate. The bar 60 is provided with an integral gusset bar 62 which extends angularly from the extending end of the bar 60 to the flat plate 54 and is fixedly attached thereto adjacent the end edge 57, so that the gusset bar 62 rigidifies the bar 60. A tab 64 is fixedly carried on the flat plate 54 so as to extend normally therefrom and an aperture 65 is formed through the tab. The tab 64 is positioned on the flat plate 54 so that it will align with the tab 42 of the door engaging member 10 as will hereinafter be described in detail.

A collar ring 68 is slidably carried on the bar 60 of the door jamb engaging member 14 and is provided with a first set screw 70 (FIG. 3) by which the collar ring is fixed against sliding movement on the bar 60, and a second set screw 72 for gripping the door jamb 20.

OPERATION

As hereinbefore mentioned, the demountable temporary door locking device of the present invention is capable of being used to lock inwardly and outwardly opening doors from either or both sides thereof. Thus, to facilitate understanding of the following operational description, the illustration of FIG. 3 is provided with side A and side B of the door/door jamb assembly.

Figure 3:
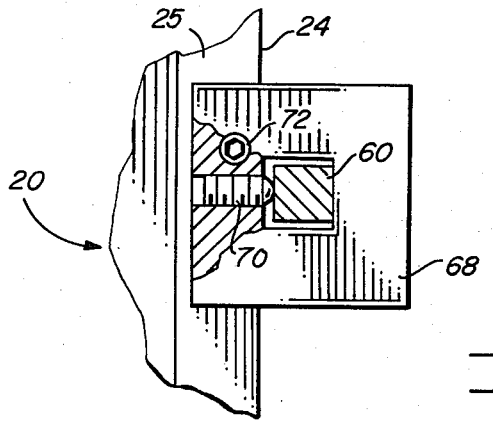
FIG. 3 is a fragmentary sectional view taken along the line 3—3 of FIG. 2.

In the situation where the door locking device is used to lock an outwardly opening door from the outside, side A, as identified in FIG. 3, is considered as being inside of the building that is to be locked, and side B is outside. In this situation, the flat plate 54 of the door jamb engaging member 14 is slidably mounted on the elongated portion 28 of the door engaging member 10. With the collar plate 12 disassembled from the tongue 30 and the door 16 open, the door jamb engaging member 14 is mounted so that it straddlingly grips the opposite side edges 25 and 26 of the door jamb stop shoulder 24. This is accomplished by placing the end edge 58 of the flat plate 54 so that it overlays the side edge 26 of the door stop shoulder 24 with a projection 74 provided on the flat plate 54 being in gripping engagement with the side edge 26. The collar ring 68, having been previously adjusted and fixed by means of set screw 70 so that the distance between it and the flat plate 54 are just slightly greater than the width dimension of the door stop shoulder 24, is brought into gripping engagement with the side edge 25 by threaded movement of the set screw 72. Thus, with the door jamb engaging member 14 in gripping engagement with the door stop shoulder 24, and the door engaging member 10 positioned as shown in FIG. 3, the tab 64 of the door jamb engaging member 14 is aligned with the tab 42 of the door engaging member 10, and although not an absolute necessity in this particular situation, a padlock 75 or a suitable pin, or bolt (not shown) may be passed through the aligned apertures 43 and 65 of the tabs. The door may then be swung into its closed position as shown in FIG. 3, and this will position the tongue 30 of the door engaging member 10 as protruding from the crack between the door 16 and its door jamb 20. The collar plate 12 is then slidingly placed on the protruding portion of the tongue 30 and a suitable padlock 76 is passed through the aligned apertures 52 and 31 to lock the collar plate 12 to the tongue in a manner which positions the collar plate so that it overlays a portion of the door 16 and may also overlap the jamb 20 and thus prevents opening of the door.

The above described locking of an outwardly opening door from the outside, side B, will not prevent the door from being opened from the inside, side A, if the padlock 75 is not used, in that by removing the pin or bolt (not shown) from the aligned tabs 42 and 64, and retracting the set screw 72 of the collar ring 68, the door jamb engaging member 14 can be slidingly moved relative to the door engaging member 10 in a direction away from the door jamb 20. When so moved, the door 16, with the door locking device of the present invention carried thereon, may be swung open in the usual manner.

In situations where it is desirable to lock the outwardly opening door from both the inside (side A) and the outside (side B) the padlock 75 is simply passed through the aligned apertures 43 and 65 of the tabs 42 and 64 respectively. This will prevent sliding movement of the door jamb engaging member 14 away from the door jamb 20 and in the absence of such sliding movement, the door 16 can not be opened due to the fact that swinging movement of the door will bring the door jamb engaging member into interfering contact with the door jamb.

In describing usage of the door locking device of the present invention in cases where locking of an inwardly opening door from the outside is to be accomplished, side B of FIG. 3 is considered as being inside the building that is to be locked, and side A is the outside. With the door 16 in the open position, the door engaging member 10 is placed in its door engaging position and the collar plate 12 is slidingly assembled on the tongue 30. Then a suitable pin or bolt (not shown) is passed through the aligned apertures 52 and 31 of the collar plate 12 and the tongue 30. With the door jamb engaging member 14 slidingly moved to its retracted position, as is indicated in dashed lines C in FIG. 3, the door 16 is moved to its closed position. The door jamb engaging member 14 is then slidably moved to its door jamb engaging position, i.e. the solid line position of FIG. 3. The set screw 72 of the collar ring 68, which was previously adjustably positioned to suit the width dimension of the door stop shoulder 24, is threadingly moved into gripping engagement with the side edge 25 of the door stop shoulder 24, and installation of the padlock 76 through the aligned apertures of the tabs 42 and 64 completes the door locking operation.

Such locking of an inwardly opening door from the outside, as described above, will allow the door 16 to be opened from the inside by simply removing the pin or bolt (not shown) which holds the collar plate 12 on the tongue 30. With the collar plate removed from the tongue, the door 16 can be opened in the usual manner, which would leave the door locking device, less the collar plate 12, in place on the door jamb 20. In situations where an inwardly opening door is to be locked from both sides, the collar plate 12 can be secured to the tongue 30 by means of the padlock 76 in place of the pin or bolt as described above.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles.

For example, the door stop engaging member 14 and the door engaging member 10 are illustrated as being slidably disassemblable elements, but this is not necessary for proper operation of the door locking device of the present invention. It has been found that retracted sliding movement of the door jamb engaging member 14 of about 1½ inches from its solid line position in FIG. 3 to its dashed line position C will allow it to clear the door jamb 20 when the door 16 is swung open or closed. Thus, the door engaging member 10 and the door jamb engaging member 14 may be configured to prevent complete disassembly but still allow the required sliding movement. This may be accomplished in any number of ways such as by providing an elongated slot (not shown) in the elongated portion 28 of the door engaging member 10, and a protruding pin or screw (not shown) in the door jamb engaging member 14 which rides in the slot.

The appended claims are therefore intended to cover and embrace any modifications within the limits only of the true spirit and scope of the invention.

What I claim is:

1. A device for demountable attachment to a door for temporary locking thereof with the door being of the type which is hingedly mounted in a door jamb having a protruding door stop shoulder, the door having opposed planar surfaces and a vertical edge which is spaced from the door jamb and defines a crack therebetween when the door is closed, said device comprising:

(a) a door engaging member including means for engaging one of the planar surfaces of the door and tongue means for protruding from the crack between the door and the door jamb when the door is closed;

(b) a collar plate for demountable mounting on the tongue means of said door engaging member for overlaying at least a portion of the opposite planar surface of the door;

(c) first locking means;

(d) means on said collar plate and on the tongue means of said door engaging member for demountably receiving said first locking means by which removal of said collar plate from the tongue means of said door engaging member is prevented;

(e) a door jamb engaging member mounted on said door engaging member for sliding movement toward and away from the door jamb when the door is closed;

(f) gripping means mounted on said door jamb engaging member for demountably attaching said door jamb engaging member to the door jamb when the door is closed and said door jamb engaging member is slidably moved toward the door jamb;

(g) second locking means; and (h) means formed on said door engaging member and on said door jamb engaging member for demountably receiving said second locking means when said door jamb engaging member is slidably moved toward the door jamb to prevent its movement away from the door jamb.

2. A device as claimed in claim 1 wherein said gripping means is adjustable for gripping door jambs having stop shoulders of various widths.

3. A device as claimed in claim 1 and further comprising means on said door engaging member for slidable mounting of said door jamb engaging member thereon.

4. A device as claimed in claim 3 wherein said means on said door engaging member for slidable mounting of said door jamb engaging member comprises:

(a) said means of said door engaging member for engaging a planar surface of the door being in the form of an elongated substantially rectangular planar member with a channel extending along at least a portion of each of the longitudinal edges thereof; and (b) said door jamb engaging member including a flat plate of substantially rectangular configuration the longitudinal edges of which are each slidably movable in a different one of the channels provided on said door engaging member.

5. A device as claimed in claim 1 wherein said door engaging member is a metal strap of substantially L-shaped configuration having an elongated portion which is the means for engaging the planar surface of the door with the tongue means extending integrally from one end of said elongated portion at substantially a right angle.

6. A device as claimed in claim 1 wherein said collar plate is formed with a slot therein for slidably receiving the tongue means of said door engaging member when said collar plate is mounted thereon.

7. A device as claimed in claim 1 wherein said collar plate comprises:

(a) a first part of oppositely facing right angle members in spaced apart juxtaposed relationship with respect to each other;

(b) a second pair of oppositely facing right angle members each affixed so as to transversely span a different aligned pair of the ends of said first pair of right angle members; and (c) said first and second pairs of right angle members defining a slot for slidingly receiving the tongue means of said door engaging member when said collar plate is mounted thereon.

8. A device as claimed in claim 1 wherein said means on said collar plate and on the tongue means of said door engaging member for receiving said first locking means comprises:

(a) said door engaging member having at least one aperture formed through the tongue means thereof; and (b) said collar plate having at least one aperture formed therethrough which aligns with the aperture of the tongue means of said door engaging member when said collar plate is mounted thereon.

9. A device as claimed in claim 1 wherein said door jamb engaging member comprises:

(a) a substantially flat plate for sliding contiguous engagement with the means for engaging the planar surface of the door of said door engaging member; and (b) a bar integral with said flat plate and extending normally therefrom, said bar disposed adjacent one end of said flat plate so as to be transverse and proximate the door jamb when said door jamb engaging member is slidingly moved toward the door jamb.

10. A device as claimed in claim 9 and further comprising a gusset bar integrally extending between the other end of said flat plate and the extending end of said bar.

11. A device as claimed in claim 9 wherein said gripping means comprises:

(a) a protrusion extending normally from the one end of said flat plate for bearing engagement with one side edge of the door jamb stop shoulder when said door jamb engaging member is slidably moved toward the door jamb; and (b) means on said bar for bearingly engaging the opposite side edge of the door jamb stop shoulder when said door jamb engaging member is slidably moved toward the door jamb.

12. A device as claimed in claim 9 wherein said means on said bar is adjustably movable thereon to accomodate different widths of the door jamb stop shoulder of the door jamb.

13. A device as claimed in claim 11 wherein said means on said bar comprises:

(a) a collar ring; and (b) a set screw mounted in said collar ring for threaded movement into bearing engagement with the opposite side edge of the door jamb stop shoulder.

14. A device as claimed in claim 13 and further comprising:

(a) said collar ring being movable along the length of said bar; and (b) means in said collar ring for securing thereof against movement along the length of said bar.

15. A device as claimed in claim 9 wherein said means on said door engaging member and on said door jamb engaging member for demountably receiving said second locking means comprises:

(a) a first tab integrally attached in normally extending spaced relationship with respect to the means for engaging a planar surface of the door of said door engaging member, said tab having an aperture formed therethrough; and (b) a second tab extending normally and integrally from said flat plate, said second tab having an aperture formed therethrough and disposed to align with said first tab when said door jamb engaging member is slidingly moved toward the door jamb.

16. A device for demountable attachment to a door for temporary locking thereof, the door being hingedly mounted in a door jamb having a protruding door stop shoulder, the door having opposite planar surfaces and a vertical edge which is spaced from the door jamb to define a crack therebetween when the door is closed, said device comprising:

(a) a planar member for engaging one of the planar surfaces of the door;

(b) a tongue plate extending normally and integrally from one end of said planar member for protruding through the crack between the door and the door jamb when the door is closed and when said planar member is in engagement with the one of the planar surfaces of the door;

(c) a collar plate for demountable mounting on the protruding end of said tongue plate for overlaying at least a portion of the opposite planar surface of the door when said planar member is in engagement with the one of the planar surfaces of the door;

(d) means for demountably locking said collar plate on the protruding end of said tongue plate;

(e) a flat plate slidably mounted on said planar member for movement toward and away from said tongue plate;

(f) bar means extending integrally from said flat plate so as to be transversely proximate the door jamb when said planar member is in engagement with the one planar surface of the door and the door is closed and said flat plate is moved toward said tongue plate;

(g) gripping means on said bar means for demountably gripping the door stop shoulder of the door jamb when said planar member is in engagement with the one planar surface of the door and when the door is closed and said flat plate is moved toward said tongue plate; and (h) means for demountably locking said flat plate to said planar member when said flat plate is moved toward said tongue plate.

* * * * *